United States Patent [19]

Griffith et al.

[11] Patent Number: 4,660,607

[45] Date of Patent: Apr. 28, 1987

[54] SENSOR CONTROLLED SAMPLING APPARATUS AND METHOD

[75] Inventors: Carl D. Griffith, Middleport; Ray P. McGranor, Niagara Fall, both of N.Y.

[73] Assignee: American Sigma, Inc., Middleport, N.Y.

[21] Appl. No.: 872,874

[22] Filed: Jun. 11, 1986

[51] Int. Cl.[4] ..... B65B 3/04

[52] U.S. Cl. ..... 141/1; 141/91; 141/94; 251/4; 417/474; 422/100

[58] Field of Search ..... 141/1-12, 141/129, 130, 89-92, 94, 95, 96; 422/100; 251/4-10; 417/474-478

[56] References Cited

U.S. PATENT DOCUMENTS 4,039,286 8/1977 Keller et al. ..... 141/130

*Primary Examiner*—Houston S. Bell, Jr.

*Attorney, Agent, or Firm*—Shlesinger, Fitzsimmons & Shlesinger

[57] ABSTRACT

A flexible tube of uniform internal diameter extends through a peristaltic pump and has its inlet communicating with a supply of liquid to be sampled. The pump is cyclically operated first in a reverse direction to purge all liquid from the tube, and then in a forward direction to pump liquid from the supply to a collector. When the pumped liquid fills a first portion of the tube for a predetermined axial distance from its inlet, a device disposed externally of the tube senses the presence of the liquid and signals a processor, which then determines the rate of flow of the liquid, and the total time $T_t$ the pump must operate to fill the entire tube plus a desired sample volume. The cycle is completed by momentarily reversing the pump to purge the first portion of the tube, and then it is operated in its forward direction for the time $T_t$.

17 Claims, 2 Drawing Figures

SENSOR CONTROLLED SAMPLING APPARATUS AND METHOD

BACKGROUND OF THE INVENTION

This invention relates to liquid sampling apparatus and an associated method of sampling liquid, and more particularly to improved sampling apparatus of the type which employs a positive displacement pump for procuring the desired liquid samples. Even more particularly this invention relates to the apparatus of the type described which has improved means for sensing and controlling the quantity of the sample supplied by the pump.

Modern day concern with environmental conservation has resulted in legislation requiring careful monitoring of wastewater effluent. This task requires the use of rather sophisticated sampling apparatus for repeatedly collecting consistently accurate samples of fluid waste or industrial process fluids. (See for example, the sampling apparatus disclosed in U.S. Pat. Nos. 3,838,719, 3,927,701 and 4,022,059.)

Heretofore three basic means generally have been employed for controlling the volume or amounts of respective samples. The first could be defined as a timed pump operation in which the pump is turned on for a predetermined period of time proportionate to the volume of the sample which is desired. The weakness of this method is that the volume is affected by changes in the vertical lift of the sample, the motor speed, which may vary due to any changes in power supply, and the ambient temperature in which the motor is operating. Another weakness of this method is that the time during which the motor must operate in order to produce the desired sample is determined empirically through trial and error.

A second method often employed has utilized a sensing device which specifically counts and calculates the revolutions of the pumps associated motor shaft or armature; and assuming that a certain amount of fluid is pumped per revolution of the motor shaft, then the desired volume of the fluid can be designated in terms of the rotations of the motor shaft. Although, theoretically, this obviates any error which might result because of unexpected changes in the speed of the motor, there nevertheless is still a considerable margin of error involved when the vertical lift changes during the period of sampling, as is often the case. This method also does not compensate for variations in the lengths of the sample tubing used, or for any accidental plugging or fouling of the line which might reduce the actual volume of fluid pumped per revolution of the motor. Furthermore this system involves the use of moving parts, and is therefore rather prone to failure.

A third method of sample collection which has been utilized comprises a so-called sample collection chamber in which a vacuum is generated to draw a sample into the chamber, which is thereafter dumped. (See for example, the above-noted U.S. Pat. No. 4,022,059.) Although this vacuum system addresses the lift and accuracy question by requiring that the chamber be filled to a certain level before being dumped, nevertheless the construction and operation of this type of apparatus is very expensive and is a rather high in power consumption, which therefore reduces its utility in connection with portable sampling applications. Also, this type of vacuum system is prone to failure because of frequent leaks, which are aggravated each time the equipment is disassembled for periodic cleaning, as is required for equipment of this type.

It is an object of this invention, therefore, to provide new and improved sampling apparatus of the type described which is substantially more reliable, accurate and inexpensive to manufacture than prior such apparatus. In this connection it is an object of this invention also to provide improved means for sensing the actual quantity of fluid delivered to, or discharged from, and associated pump during each sampling operation.

Another object of this invention is to provide an improved method of sampling liquids, and which method is substantially more accurate in measuring the volume of the sample, and which is particularly suited for use with a microprocessor that controls repeated and accurate sampling operations.

A further object of this invention is to provide a novel, non-contacting, non-obstructing sensing means for sensing the presence of a liquid sample in the tubing which is associated with the inlet of the sampling pump of this apparatus.

Additional objects will be apparent from the specification, the appended claims, and the accompanying drawings.

SUMMARY OF THE INVENTION

The apparatus includes an elongate, preferably flexible tube, which is disposed to be inserted at one end into the supply of liquid or fluid which is to be sampled, and the other end of which is connected through a conventional, reversible peristaltic, positive displacement roller pump to the container which is to receive the sample. Adjacent to the tubing at the inlet to the pump is a special noncontacting fluid sensor of the capacitive or ultrasonic type, which produces and electrical signal in response to the presence of fluid in the tube at that particular point. The output signal of the fluid sensor is fed to a microprocessor and real time clock along with data indicating (1) the desired sample aliquot volume, (2) the internal volume of the tube from the fluid supply to the sensing point, and (3) the internal volume of the tubing from the sensing point to the collector. This latter information (2 and 3) can be readily determined when the inner diameter and length of the tubing are known, and in many cases will constitute fixed values for all sampling. Hence the volume of liquid required to fill per linear foot of the tubing also can be determined in advance of sampling. The overall length of the tubing which is employed to select the sample may differ depending upon the locus of the subject matter being sampled, but whenever this overall length is changed, of course, the corresponding input data to the microprocessor must also be changed. Similarly, the desired volume of the sample may likewise be changed at the microprocessor input as desired.

Accordingly, assuming that the three above-noted data (1), (2) and (3) are supplied to the processor along with the signal from the sensor, it is possible for the processor and its associated program immediately to determine a particular time/volume relationship, so that when the operation is initiated the processor will, under the control of the signal from the sensor, operate the associated peristaltic pump repeatedly in cycles. During each cycle the pump is reversed to purge the tubing, operated in a forward direction until liquid appears at the sensor, is again reversed to purge the tubing, and finally is operated in a forward direction for an interval of time ($T_t$) sufficient to fill the entire tube and to provide an accurate sample of the fluid or liquid being monitored. After time ($T_t$) the pump is again reversed to purge the tubing before producing a cycle complete signal.

THE DRAWINGS

FIG. 1 is a fragmentary perspective view of improved sampling apparatus made according to one embodiment of this invention; and FIG. 2 is a block diagram representing the various steps formed by a microprocessor connected to the apparatus of FIG. 1 to effect sampling operation in accordance with the improved method disclosed herein.

DETAILED DESCRIPTION OF PREFERRED EMBODIMENT

Figure 1:
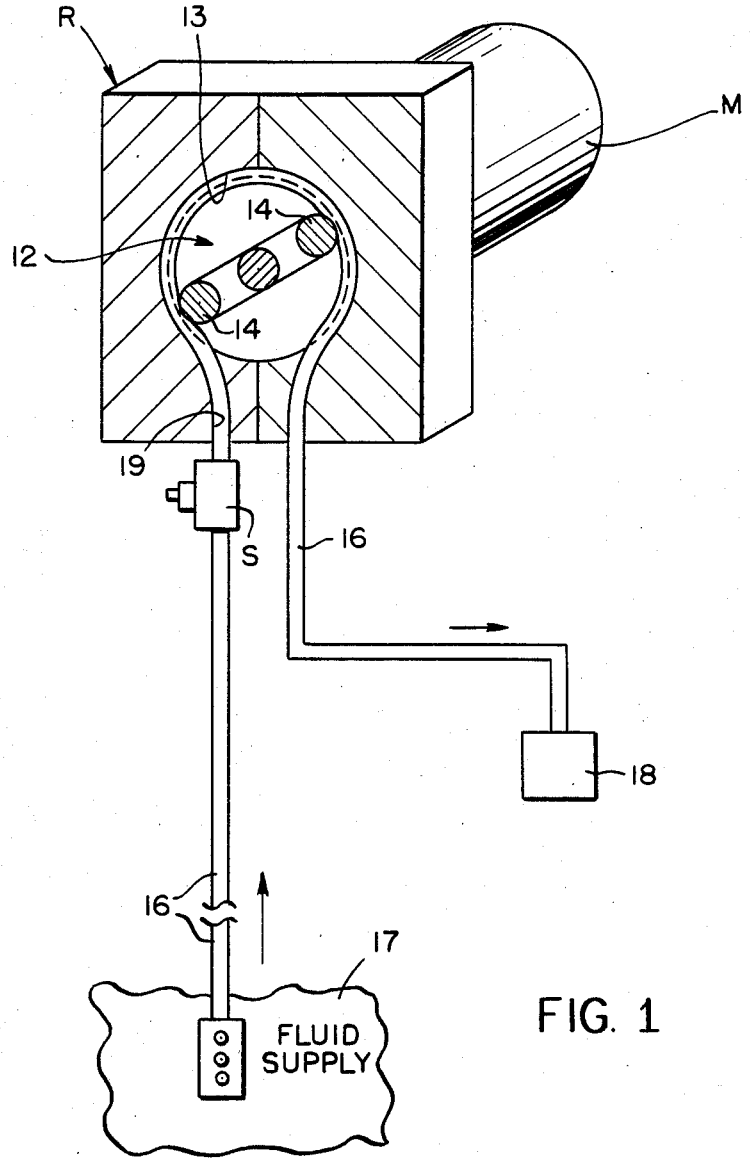

Referring now to the drawings by numerals of reference, and first to FIG. 1, P denoted generally a peristaltic positive displacement roller pump of conventional design, which includes a rotor 12 that is driven coaxially in a cylindrical bore 13 in the pump housing by an electric, reversible motor M. Rotor 12 has thereon a plurality of rotatable rollers 14, which upon rotation of the rotor 12 have rolling engagement with a section of flexible tubing 16, which extends intermediate its ends into chamber 13 and around the outside of the array of rollers 14. Tubing 16 communicates at one end with a supply 17 of fluid, and at its opposite end with a sample container or collector 18, so that when the rotor 12 is rotated by the motor M, the action of the rollers 14 on the tubing 16 causes fluid to be drawn from the supply and to be fed through the pump P to the sample collector 18.

The pump P is a conventional, reversible, positive displacement pump, preferably of the peristaltic variety, and may be of the type made, for example, by American Sigma, Inc. as model 850.

In the embodiment illustrated, a portion of the tubing 16 adjacent to the pump inlet 19 is positioned adjacent a non-contacting sensor S, which preferably is an electrostatic capacitance type proximity switch, which is sold, for example, by Omron Tateisi Electronics Company as model type E2K. Such a device employs a sensing electrode, which forms part of an oscillator circuit, and which is disposed adjacent to, but externally of tubing 16 as shown in FIG. 1. When liquid appears in the tubing opposite sensor S, it generates an output signal which is applied to the associated microprocessor as disclosed hereinafter.

Alternatively the sensor S may be of the ultrasonic variety, such as for example the type developed by Sigma, Inc. for monitoring liquid.

Figure 2:
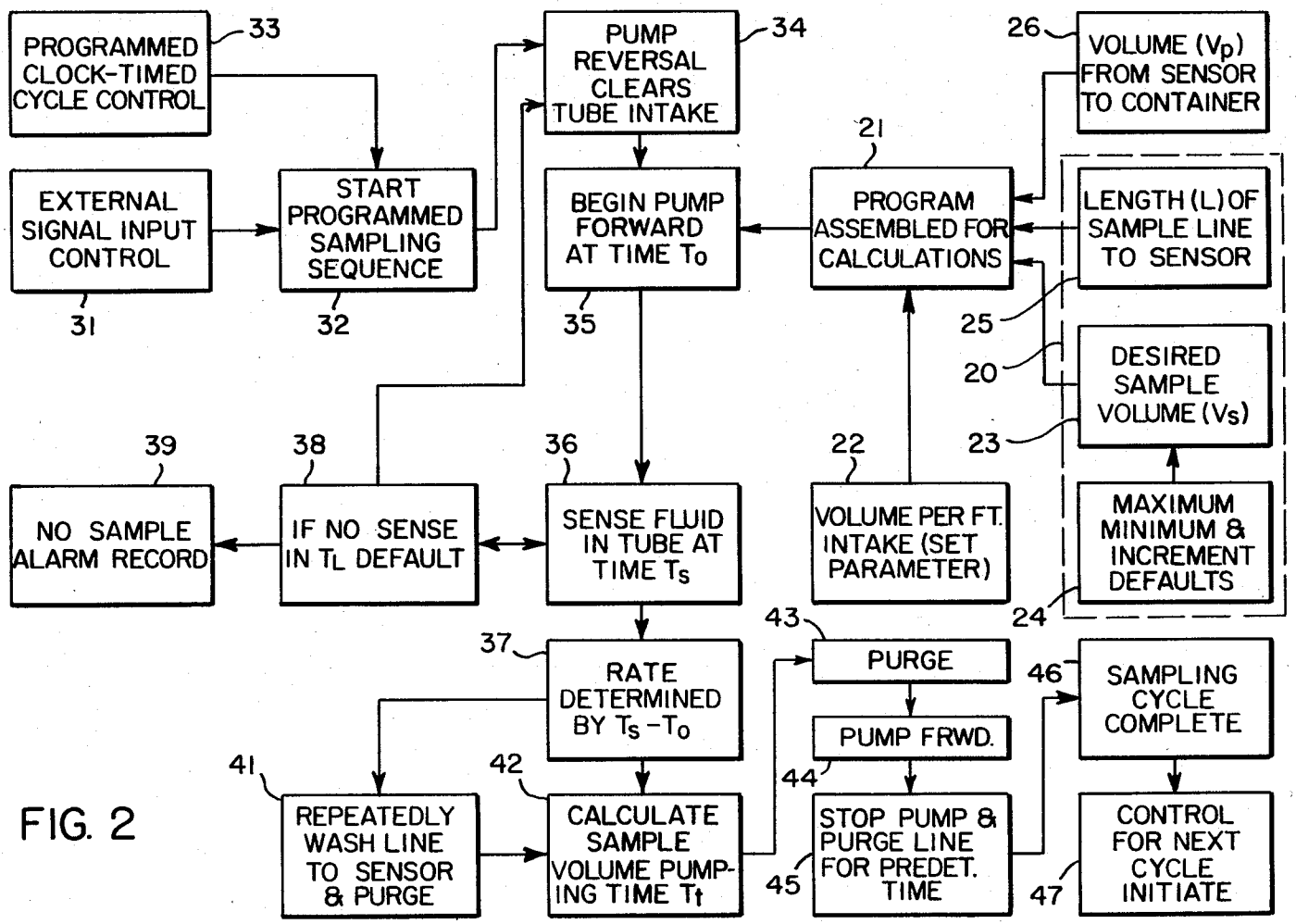

Referring now to the pump control diagram of Fig. 2, the associated microprocessor includes a keyboard input section, which is illustrated within the broken line denoted at 20 in FIG. 2. Information from section 20 is fed to a program assembly section 21 where calculations are effected. The program employed with this embodiment is designed for use with tubing 16 having a uniform internal diameter, although if tubing of a different diameter is employed the program would be changed accordingly. Consequently, the volume per linear foot is shown in FIG. 2 at 22 as constituting a set parameter that is applied to the assembly section 21.

Because of the manner in which the liquid samples are measured in accordance with the invention, the volume $V_p$ of liquid contained in the tubing section between the sensor S and the container 18 at the completion of a sampling operation actually does not enter the container, but is instead purged from the apparatus. To compensate for this amount, the length of the tubing between the point S and the collector 18 is preprogrammed as at 26 into the assembly section 21 and converted to $V_p$. Ideally the length of the section of tubing 16 between the sensor S and collector 18 remains constant for all sampling operations, and therefore is in essence a fixed value; although it could be changed by modifying the program, if necessary.

The variable parameters associated with sampling operations include the desired volume $V_s$ of each sample to to be taken; and at the commencement of a sampling sampling operation this value is entered as at 23 through the keyboard to the program assembly section 21. If desired, the value $V_s$ may include maximum/minimum and increment defaults, as denoted at 24. Another variable which is keyed as at 25 into the assembly section 21 is that first portion or length L of the tubing 16 which is used for conveying fluid from the supply 17 (FIG. 1) to the sensing point S.

As thus far described, those portions of the program denoted at 21 through 26 are determined in part by preset software parameters, and as in the case with 23, 24 and 25, by user inputs through the keyboard of the associated processor.

At the outset of an operation, and assuming that the inlet end of the sampling tubing 16 is immersed as necessary in the fluid supply 17 which is to be sampled, and assuming that the necessary input parameters have been entered into the associated processor, an external signal is applied at 31 to that portion 32 of the processor which commences a programmed sampling sequence under the control of a clock-timed cycling section 33. At the beginning the pump P is reversed as at 34 in order completely to purge the tubing 16. Thereafter the pump is driven by the motor M in a forward direction commencing at time $T_O$, thereby to begin filling the tubing with fluid from the supply. This also triggers a timing device which continues to operate until the sensor S detects the presence of liquid or fluid in the tubing, at which time ($T_s$) the sensor S signals the processor that the first section of tubing 16 between the supply 17 and the sensor S is now filled with a fluid sample. When, as at 36, this signal is generated, the processor then calculates as at 37 the exact time ($T_s - T_o$) it took to completely fill this first section of tubing 16.

There may be instances in which the pump P is operated in a forward direction but fails to draw fluid from the supply 17 to the locus of sensor S, such as for example when equipment fails, or the level of the fluid supply 17 accidentally falls beneath the lower, inlet end of tubing 16. For this reason the equipment includes a "fail safe" 38 which, if within a predetermined time limit $T_L$ after time $T_o$, determines that no signal has been generated by the sensor output 36, then device 38 signals the pump reversal section 34 to abort the sampling operation, and also signals a sample alarm device 39, which can be used to record and to indicate to an operator that the sensor 36 is not sensing the presence of fluid in tubing 16 within the alloted time limit $T_L$.

Assuming, however, that the equipment is operating properly, and that fluid is sensed in tubing 16 by sensor S within the alloted time limit $T_L$, the section 37 then calculates, as noted above, the time ($T_s - T_o$) that it took the fluid to reach the sensor S.

Section 37 also triggers or enables a rinse and purge section 41, which can be adjustably preset to cause repetition of steps 34, 35, 36 and 37 one or more additional times, thereby repeatedly to purge and rinse the section of tubing between the fluid supply 17 and the sensor S. Each time this rinsing and purging takes place, the time which it takes to draw fluid from the supply 17 to the sensor S is updated or averaged at 37.

After the first tubing section has been purged the desired number of times, a signal is generated at the output of 41 to enable the calculation as at 42 of the overall time or total $T_t$ that the pump P must be operated, in the light of the time $T_s - T_o$ as determined at 37, in order to convey to container 18 at the exact quantity or volume of the sample of the liquid that is desired. Section 42 then generates an output signal which enables a purge repeat section 43, which, as in the case of section 34, initiates a purging operation to empty line 16. When this purge has been completed, section 43 enables a begin pump forward section 44, which then causes the pump to operate in its forward direction for time $T_t$. As noted above, the processor has already been preprogrammed, to compensate for the volume $V_p$ of the fluid which it takes to fill the second tubing section, so that the time $T_t$ will include the time that it takes to fill, both the first and second tubing sections, as well as the time required to pump the desired sample aliquot.

After the desired sample has been collected as determined by the time $T_t$ the processor section 44 applies to section 45 a signal which causes the pump P again to be reversed in order to purge the entire tubing 16. This purging takes place for a predetermined period of time after which the equipment generates as at 46 a cycle complete signal. This signal then generates at 47, after a programmed time interval or amount of sample flow, a signal which can be applied to section 33 in order to commence another sampling cycle.

From the foregoing it will be apparent that the above-described apparatus has the advantage not only of isolating the liquid sample from the associated equipment—i.e. the sample contacts only the tubing 16 and the container 18—it also enables the readjust spacing operator to select the desired number of rinse cycles effected as at 41. Moreover, since the entire tubing 16 is purged following each sampling operation, and the first section of tubing 16 (from supply 17 to sensor S) is again purged immediately prior to the actual sample pumping step, the time required to fill the first section will be an accurate measurement because at the outset there will be no residual fluid remaining in the lower end of the tube, such as might be caused by excessive changes in the level of the fluid sampled. Additionally, this time interval is repeatedly measured when the first section of tubing is repeatedly purged prior to drawing a sample, and the average of these intervals can be used to insure the most accurate calculation of time $T_t$.

While this invention has been described in detail in connection with the use of a continuous piece of tubing 16, it will be apparent that this has been done merely for ease of description, and that as a matter of fact the tubing could be in the form of several pieces coupled together. In this connection it will be apparent that the length and hence volume of the tubing 16 from the sensor S to the collector 18 usually remains fixed and may be preprogrammed while the section of tubing from the supply 17 to the sensor S may often differ in length depending upon the location of the input data at 25. Moreover, this particular section of the tubing is critical, because any change in its length and hence overall volume, will impact on the value of the rate at which the fluid is being pumped. Therefore, it is possible to construct this section of the conduit from pieces of tubing or the like having different internal the supply 17, and therefore may often require a change in diameters provided the overall internal volume of this section of the conduit (from supply 17 to sensor S) is made part of the program, as for example at 21.

Furthermore, instead of purging the first section of the tubing prior to each pumping step in response to the output signal of sensor S, it would be possible to eliminate or skip sections 43 and 44, and to program the microprocessor to cause the pump to continue operating in its forward direction immediately following the determination of $T_s - T_o$. In such case the time calculated at 42 would constitute the remaining time the pump would have to be operated in order to pump an additional volume of liquid equal to $V_p$ plus the desired sample. In that case section 42 would enable section 45 directly.

While this invention has been illustrated and described in detail in connection with only certain embodiments hereof, it will be apparent that it is capable of still further modification, and that this application is intended to cover any such modifications as may fall within the scope of one skilled in the art, or the appended claims.

We claim:

1. A method of improving the quantitative accuracy of liquid sampling apparatus, comprising connecting the inlet of a reversible, positive displacement pump to a supply of liquid by a first conduit having a known internal volume from its inlet end to a point axially spaced a predetermined distance along said first conduit from said inlet end thereof, connecting the outlet of the pump by a second conduit to a collector disposed to receive as a sample a predetermined volume of said liquid, determining a first volume ($V_p$) of liquid required to fill the pump and those portions of the conduits between said collector and said point in said first conduit, operating said pump in a reverse direction to purge said pump and conduits of liquid, operating said pump in a forward direction to commence pumping liquid from the supply thereof to said collector, detecting a first interval of time ($T_s - T_o$) required for the liquid from said supply to appear at said point in said first conduit, based on said first time interval, calculating the rate of flow of said liquid to said point, and the total pumping time ($T_t$) required to convey said predetermined volume of liquid from said supply to said collector, and operating said pump in a forward direction for said total time ($T_t$).

2. The method as recited in claim 1, including momentarily operating said pump in a reverse direction to purge said first conduit of liquid after detection of said first interval of time, and before operating said pump in its forward direction for said total time ($T_t$).

3. The method as recited in claim 1, including continuing to operate said pump in its forward direction after detection of said first interval of time, and for an overall time equal to said total time ($T_t$).

4. The method as recited in claim 1, including the end of said pumping time ($T_t$) reversing the operation of said pump to purge the pump and said conduits of liquid.

5. The method as recited in claim 1, including reversing the operation of said pump if said first time interval ($T_s-T_o$) is detected, thereby repeatedly to rinse the portion of said first conduit between its inlet end and said point before operating said pump in its forward direction for said total time ($T_t$).

6. The method as recited in claim 1, including reversing the operation of said pump if said first time interval ($T_s-T_o$) exceeds a predetermined value.

7. The method as recited in claim 1, including generating an alarm signal if said first time interval ($T_s-T_o$) exceeds a predetermined value.

8. The method as recited in claim 1, wherein detecting said first interval of time ($T_s-T_o$) includes sensing each time liquid appears in said first conduit at said point, said sensing of said liquid being performed without contacting said liquid and without obstructing its flow in said first conduit.

9. The method as recited in claim 8, wherein said sensing of said liquid includes positioning an electrostatic capacitance type of proximity switch adjacent the exterior of said first conduit to generate an output signal each time liquid appears in said first conduit adjacent said switch.

10. The method as recited in claim 8, wherein said sensing of said liquid includes applying ultrasonic energy to said point in said first conduit, and from the exterior of said first conduit.

11. A method of improving the quantitative accuracy of liquid sampling apparatus, comprising passing a flexible tube of uniform internal diameter, and therefore of uniform internal volume per unit length, through the operating chamber of a peristaltic pump, with the inlet of the tube communicating with a supply of liquid that is to be sampled, and with its outlet connected to a sample collector, operating the pump in a reverse direction to purge all liquid from the tube, operating the pump in a forward direction to commence pumping liquid from the supply thereof to said collector, sensing when the pumped liquid reaches a point in said tube spaced a predetermined axial distance along said tube from the inlet thereof, determining the interval of time ($T_s-T_o$) taken for the liquid to fill the first portion of the tube from its inlet to said point, and based upon said time interval, calculating the rate of flow of the liquid being pumped, and the total time ($T_t$) the pump must operate to convey a sample of predetermined volume from said supply to said collector, reversing the operation of the pump to purge said first portion of the tube of said liquid, and thereafter operating said pump in its forward direction for said total time ($T_t$).

12. The method as defined in claim 8, wherein said sensing includes using a sensing device positioned exteriorly of said tube adjacent said point to detect each time liquid from said supply appears at said point, whereby said sensing step occurs without physically contacting or interfering with the flow of the liquid in said tube.

13. The method as recited in claim 11, including before operating said pump in a forward direction, and for a predetermined number of times, operating said pump in a reverse direction each time said time interval ($T_s-T_o$) is determined.

14. In combination with a reversible, positive displacement pump having an inlet connected by a first conduit to a supply of liquid, and an outlet connected by a second conduit to a sample collector, and said pump being operable selectively in a forward direction to pump liquid from said supply to said collector, and in a reverse direction to purge liquid from said pump and said conduits, improved pump control means for cyclically and intermittently delivering liquid samples from said supply to said collector, comprising cycle initiating means operative in response to a start signal momentarily to operate said pump in a reverse direction to purge liquid from said pump and said conduits, and then to operate said pump in a forward direction to commence pumping liquid from said supply toward said collector, sensing means positioned externally of said first conduit and operative without touching said liquid to generate a sensing signal each time the liquid appears in said first conduit at a point spaced a predetermined axial distance along said first conduit from the inlet end thereof, timing means responsive to said sensing signal for determining the interval of time ($T_s-T_o$) it took liquid to pass from the inlet end of said first conduit to said point, and means responsive to said timing means for determining the rate of flow of the liquid passing said point and the time ($T_t$) necessary at said rate to pump a volume of liquid equal to the internal volume of said pump and said conduits from said point to said collector, plus the desired volume of one sample, said cycling means including means for continuing to operate said motor in a forward direction for said remaining time ($T_t$).

15. The combination as defined in claim 14, wherein the last-named means includes means for generating a purge signal momentarily to effect operation of said pump in its reverse direction after said pump has been operated in its forward direction for said interval of time ($T_s-T_o$).

16. The combination as defined in claim 15, wherein said timing means includes means operative for a predetermined number of times, before operating said pump in its forward direction for said time ($T_t$), to generate said purge signal each time said time interval ($T_s-T_o$)is determined, thereby repeatedly to rinse said first conduit between its inlet end and said point before pumping a sample to said collector.

17. The combination as defined in claim 14, including means for generating a warning signal if said time interval ($T_s-T_o$) exceeds a predetermined value.

* * * * *